US006335135B1

(12) United States Patent
Arai et al.

(10) Patent No.: US 6,335,135 B1
(45) Date of Patent: Jan. 1, 2002

(54) TONER FOR DEVELOPING ELECTROSTATIC LATENT IMAGE

(75) Inventors: Takeshi Arai, Akashi; Junichi Tamaoki, Sakai; Masayuki Hagi, Minoo; Megumi Aoki, Itami, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/477,369

(22) Filed: Jan. 4, 2000

(30) Foreign Application Priority Data

Jan. 13, 1999 (JP) ..... 11-006311

(51) Int. Cl.[7] ..... G03G 9/08
(52) U.S. Cl. ..... 430/108.6
(58) Field of Search ..... 430/110, 111, 430/108.6, 111.4

(56) References Cited

U.S. PATENT DOCUMENTS

| | | | | |
|---|---|---|---|---|
| 4,626,487 A | | 12/1986 | Mitsuhashi et al. | 430/109 |
| 5,547,796 A | * | 8/1996 | Kohtaki et al. | 430/110 |
| 5,759,731 A | | 6/1998 | Hagi et al. | 430/106.6 |
| 5,776,646 A | | 7/1998 | Hagi et al. | 430/106.6 |
| 5,827,632 A | * | 10/1998 | Inaba et al. | 430/110 |
| 5,858,597 A | * | 1/1999 | Mizoh et al. | 430/110 |
| 6,022,661 A | * | 2/2000 | Kurose et al. | 430/110 |
| 6,025,107 A | * | 2/2000 | Sekiguchi et al. | 430/110 |

* cited by examiner

*Primary Examiner*—Janis L. Dote
(74) *Attorney, Agent, or Firm*—Burns, Doane, Swecker & Mathis, LLP

(57) ABSTRACT

The present invention relates to a toner comprising toner particles and an external additive comprising strontium titanate particles that have a number-average particle size of 80 to 800 nm and do not have a peak of strontium carbonate in qualitative analysis by X-ray diffraction.

18 Claims, 2 Drawing Sheets

TONER FOR DEVELOPING ELECTROSTATIC LATENT IMAGE

RELATED APPLICATIONS

The present invention is based on Japanese Patent Application No. 11-6311, the content of which is hereby incorporated by reference.

BACKGROUND OF THE INVENTION

1. Field of the Invention

The present invention relates to a toner for developing an electrostatic latent image for use in electrostatic printing, electronic photographs and the like.

2. Description of the Related Art

The demand for a high degree of fluidity in toners for colorization and digitalization of printers and copiers in recent years typically has been achieved by adding to the toner inorganic fine particles such as silica fine particles and titania fine particles and the like as a fluidizing agent. However, when a large amount of such fluidizing agent is added to achieve a high degree of fluidity, disadvantages often arise inasmuch as the fluidizing agent may pass through the cleaner unit provided with a blade cleaning mechanism so as to remain on the photosensitive member and cause filming and black spots (BS) on the image which are called image defects.

A toner has been proposed for preventing filming and black spots as well as participating in polishing by the cleaner unit, by adding to inorganic particles having a number-average particle size of approximately 80~800 nm to the toner, particularly strontium titanate particles to counter the aforesaid disadvantages. However, it is well known that inorganic particles are treated by hydrophobic processing via surface processing by a silane coupling agent so that the fluid characteristics and electrostatic properties will not change even under variable humidity and temperature environments.

When strontium titanate particles having a number-average particle size of approximately 80 to 800 nm are subjected to such hydrophobic processing, the surface treating agent does not adequately treat the strontium titanate particles, and since the hydrophobicity is not improved, there is only minor improvement in toner charge level adjustability or charge environmental stability despite the addition of the hydrophobic strontium titanate.

SUMMARY OF THE INVENTION

An object of the present invention is to provide a toner having excellent charge environmental stability.

Another object of the present invention is to provide a toner having excellent charge level adjustability.

Yet another object of the present invention is to provide a toner having excellent polishing characteristics.

The present invention relates to a toner comprising toner particles and an external additive comprising strontium titanate particles that have a number-average particle size of 80 to 800 nm and do not have a peak of strontium carbonate in qualitative analysis by X-ray diffraction.

DETAILED DESCRIPTION OF THE PREFERRED EMBODIMENTS

Figure 1:
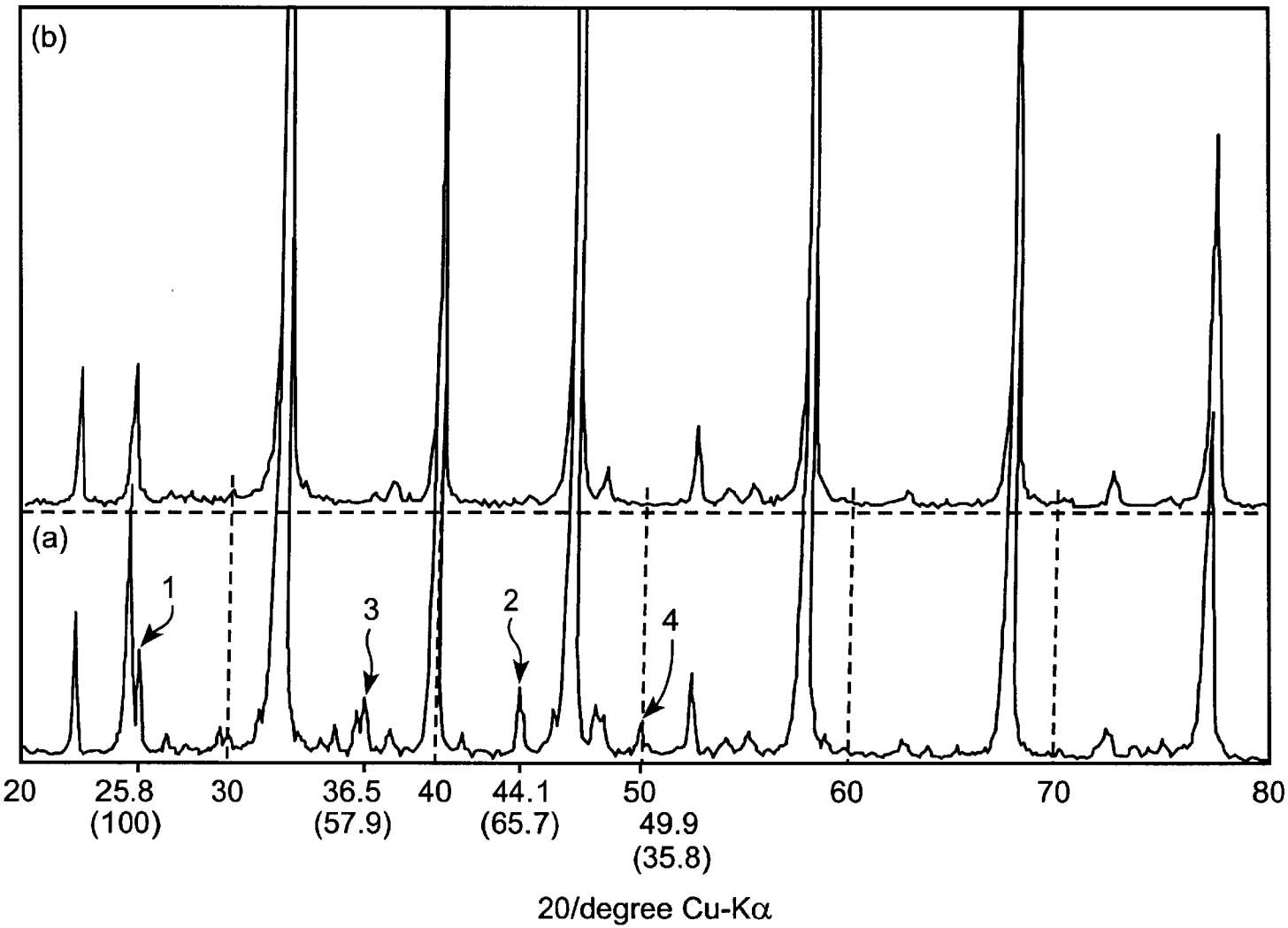
FIG. 1 is a chart obtained by qualitative analysis via X-ray diffraction of strontium titanate. Part (a) of the drawing shows a chart obtained by qualitative analysis via X-ray diffraction of strontium titanate including strontium carbonate. Part (b) shows a chart obtained by qualitative analysis via X-ray diffraction of strontium titanate that does not include strontium carbonate.

The present invention relates to a toner comprising toner particles and an external additive comprising strontium titanate particles that have a number-average particle size of 80 to 800 nm and do not have a peak of strontium carbonate in qualitative analysis by X-ray diffraction.

The strontium titanate particles generally are manufactured by subjecting titanium oxide and strontium carbonate to a solid phase reaction followed by sintering, with the absence of unreacted strontium carbonate from the large strontium titanate particles of a number-average particle size greater than 1 $\mu$m which are generally used as electronic material being verified by X-ray qualitative analysis. However, the particle size must be regulated while sintering when manufacturing the small strontium titanate particles, particularly strontium titanate particles having a number-average particle size of 80 to 800 nm. That is, when manufacturing the small strontium titanate particles, sintering must occur at a lower temperature than when manufacturing large strontium titanate particles. As a result, it is clear that the strontium carbonate naturally remains as the unreacted part. The inventors of the present invention observed the residual strontium carbonate of the small strontium titanate particles, and discovered that when the strontium titanate particles excluding the residual strontium carbonate are subjected to hydrophobic treatment using a surface treating agent such as silane coupling agent or the like, strontium titanate particles are obtained which have excellent charge level regulating characteristics and charge environmental stability. The residual unreacted strontium carbonate in the strontium titanate particles is believed to reduce the surface activity of the particles, and is thought to be the causative factor impairing the hydrophobic treatment via surface treating agents such as silane coupling agent.

In the toner of the present invention, the external additive mixed (coating) the toner particles include strontium titanate particles.

The strontium titanate particles used in the present invention have a number-average particle size of 80 to 800 nm, and desirably 150 to 600 nm. There is inadequate polishing effect of the particles in the cleaner unit when the number-average particle size is less than 80 nm, and particles may damage the photosensitive member when the particle size exceeds 800 nm due to excessive an polishing effect. Preferable strontium titanate particles have a content of number particle size of 1000 nm or greater of less than 20 number-percent, and desirably less than 10 number-percent. When the content of particles of number size 1000 nm or greater exceeds 20 number-percent, the number-average particle size is less than 800 nm, and damage to the photosensitive member readily occurs. In the present specification, number-average particle size means the average primary particle size, i.e., the average size of unflocculated particles, and number-particle size means the primary particle size, i.e., and the particle size of unflocculated particles. The number-average particle size of the strontium titanate particles can be determined by observing the particles using a transmission electron microscope, and averaging the measured particle size of 100 particles. During measurement the magnification is set at 40,000x~60,000x to observe objects of 0.5 nm or greater.

The strontium titanate particles used in the toner of the present invention do not exhibit the peak of strontium carbonate as determined by qualitative analysis via X-ray diffraction. Qualitative analysis via X-ray diffraction is not specifically limited to qualitative analysis by X-ray diffraction using a defractometer method inasmuch as analysis may be accomplished using, for example, a high-intensity full-automatic X-ray diffraction apparatus MXP18 (manufactured by McScience Co., Ltd.). This analysis may be performed before or after hydrophobic treatment of the strontium titanate particles. The analysis may be thus performed because the strontium titanate particles of the hydrophobic process do not include strontium carbonate.

In the present invention, "does not include the peak of strontium carbonate," means the peaks 1 to 4 of strontium carbonate does not assay as described below in qualitative analysis by X-ray diffraction of the aforesaid particles. For example, Part (a) of FIG. 1 shows the qualitative analysis via X-ray diffraction of strontium titanate particles A including strontium carbonate obtained in the examples described below and assayed under the following measurement conditions. Strontium carbonate has characteristic peaks of peaks 1 to 4. Peak intensity at peak 1 expressed at $2\theta$=approximately 25.8 degrees was designated 100, peak 2 expressed at $2\theta$=approximately 44.1 degrees was approximately 66, peak 3 expressed at $2\theta$=approximately 36.5 degrees was approximately 58 degrees, and peak 4 expressed at $2\theta$=49.9 degrees was approximately 36. In the present invention, it is stipulated that these peaks are not included when the peaks cannot be differentiated from noise. "The peaks cannot be differentiated from noise," means the peaks were not apparent using the noise baseline as a standard.

In the present invention, it is desirable to use hydrophobic strontium titanate particles comprising the previously mentioned strontium titanate particles subjected to surface processing with hydrophobic agent. Furthermore, the hydrophobia strontium titanate particles have a hydrophobicity of 40% or greater, and desirably 50 to 80%. It is believed that the excellent charge level adjustability and charge environmental stability of the toner of the present invention is achieved by using hydrophobic strontium titanate particles of the aforesaid degree of hydrophobicity. Hydrophobicity can be measured by a methanol titration method.

The method of manufacturing the hydrophobic strontium titanate particles used in the present invention is not specifically limited inasmuch as various methods may be used including, for example, immersing strontium titanate particles obtained by a well known method in a strong acid solution, washing the particles, drying the particles, and subsequently subjecting the particles to hydrophobic processing via surface treatment by a well known method.

Specifically, for example, after adding $TiO_2$ and an equal molar quantity of $SrCl_2$ to a meta titanate slurry obtained by a sulfuric acid method or the like, ammonia water is added while simultaneously introducing $CO_2$ gas at double the molar quantity of $TiO_2$. Thereafter, the obtained precipitate is washed in water, and after drying for one day at 110° C., sintered at 900° C. to produce strontium titanate particles having a number-average particle size of 200 to 500 nm. A chart obtained by qualitative analysis via X-ray diffraction of the strontium titanate particle produced above is shown in part (a) of FIG. 1. This chart confirms the presence of strontium carbonate via the presence of peaks 1 to 4.

Then, the strontium titanate particles with residual strontium carbonate obtained as described above are immersed in a strong acid solution to elute the strontium carbonate. It is desirable to mix the material while immersed in the acid solution, and it is further desirable to wash and dry the particles after the immersion.

The chart in part (b) of FIG. 1 shows example data obtained by qualitative analysis via X-ray diffraction of the strontium titanate particles produced as described above. In part (b) of the drawing, the original peaks 1 to 4 of the strontium carbonate express in the chart of part (a) have been eliminated. From these charts it can be understood that the strontium carbonate has been eluted via the immersion process in the strong acid solution, and as a result no strontium carbonate remains on the particles.

The hydrophobic strontium titanate particles used in the toner of the present invention are obtained by subjecting the strontium titanate particles which do not contain strontium carbonate produced in the aforesaid manner to hydrophobic treatment using a surface treating agent via a well known method. The surface-treating agent (hydrophobic agent) may be a positive-charging surface treating agent when imparting a positive chargeability to the surface of the strontium titanate particles, or may be a negative-charging surface treating agent when imparting a negative chargeability to the particles. Examples of useful positive-charging surface treating agents include well-known surface treating agents having an amino group, nitrile group, or isocyanate group. For example, synthetic resins such as urethane-transformed resin, acrylonitrile resins and the like, silane coupling agents such as γ-(2-aminoethyl) aminopropyltrimethoxysilane, γ-(2-aminoethyl) aminopropyltrimethoxysilane, γ-(2-aminoethyl) aminopropylmethyldimethoxysilane, aminosilane, γ-aminopropyltriethoxysilane, N-(2-aminoethyl)3-aminopropyltrimethoxysilane, N-β-(N-vinylbenzylaminoethyl)-γ-aminopropyltrimethoxysilane and the like, and silicone oils such as amino-transformed silicone oil and the like may be used for surface processing via well known dry methods or wet methods.

Examples of useful negative-charging surface treating agents include well known surface treating agents which do not contain an amino group or a nitrile group, e.g., silane coupling agent, silicone oil and the like. Examples of useful silane coupling agents include hexamethyldisilazane, trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, vinyltriacetoxysilane and the like which are usable as surface treating agents in well known wet methods and dry methods. Examples of useful silicone oils include dimethylpolysiloxane, methylhydrozenepolysiloxane, methylphenylpolysiloxane and the like which are usable as surface treating agents in well-known wet methods and dry methods. When strong negative chargeability is desired, fluorine-containing silane coupling agent and fluorine containing silicone oils may be used, but such agents are not suitable for aqueous wet methods due to the repellency of fluorine.

Surface processing of the strontium titanate particles via hydrophobic agent can be accomplished, for example, by diluting the hydrophobic agent with a solvent, mixing the dilute solution with the microparticles, heating and drying the mixture, then cracking the microparticles via a dry method, dispersing the microparticles in water to form a slurry to which is added hydrophobic agent, and after mixing the slurry is heated and dried and subsequently cracked via a wet method.

When an external additive is added to the particles having a size of 80 to 800 nm, the toner transitions to the negative polarity side due to an interaction effect when the external additive has a positive polarity because the external additive is readily freed from the toner particles. That is, when the toner has a negative polarity, the charge level rises (negativity increases), whereas a converse action occurs when the external additive has a negative polarity.

The charge level is finely adjustable within a usable range without modifying the toner constituents or small size external additive. (Adjustment of the charge level by toner constituents and small size external additive produces changes in fluidity and fatigue, such that the total balances may easily collapse.

The toner of the present invention is has the hydrophobic strontium titanate particles described above mixed with (coating) well known toner particles comprising at least a binder resin and colorant.

Well-known binder resin and natural resins may be used as the binder resin used in the toner particles forming the toner of the present invention. Specific examples of usable resins include natural resins and synthetic resins such as styrene resin, acrylic resin, olefin resin, diene resin, polyester resin, polyamide resin, epoxy resin, silicone resin, phenol resin, petroleum resin, urethane resin and the like.

Well-known pigments and dyes may be used as colorants. Examples of usable materials include carbon black, aniline blue, calco oil blue, chrome yellow, ultramarine blue, Du Pont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. red 184, C.I. pigment yellow 97, C.I. pigment yellow 12, C.I. pigment yellow 17, C.I. solvent yellow 162, C.I. pigment blue 15:1, C.I. pigment blue 15:3 and the like. When a magnetic toner is used, the aforesaid colorants may be substituted by magnetic material in whole or in part. Magnetite, ferrite, iron powder, nickel and the like may be used as the magnetic material.

Additives such as charge controller, releasing agent and the like may be added to the binder resin as necessary for use in the toner particles of the present invention. Examples of useful charge controllers include metallic dyes such as fluoride surfactant, salicylic acid metal complex, azo metal compounds and the like, azine dyes such as macromolecule acids such as copolymers containing maleic acid as a monomer component, tertiary ammonium salt, nigrosine and the like, and carbon black and the like.

Examples of useful releasing agents include paraffin and olefins and the like having 8 or more carbon atoms, e.g., paraffin wax, paraffin latex, microcrystalline wax, low molecular weight polypropylene wax, low molecular weight polyethylene wax and the like.

The toner particles in the present invention may be manufactured by well-known methods, particularly general kneading/pulverization methods. That is, a typically used method includes fusion kneading the binder resin, colorant and other additives using a kneading machine, then cooling, and thereafter pulverizing and classifying the particles. Toner particles obtained in this way desirably have a volume-average particle size of 4 to 12 $\mu$m, preferably 4 to 9 $\mu$m. When the volume-average particle size is smaller than this range, fluidity is reduced and fogging may readily occur, whereas when the size is larger than this range, resolution is reduced and high quality images cannot be obtained.

When coating the toner particles with hydrophobic strontium titanate described above, there is no particular restrictions insofar as a uniform mixture of the toner particles and the hydrophobic strontium titanate particles is achieved, but it is desirable that the hydrophobic strontium titanate particles are uniformly mixed to 0.3 to 5.0 pbw (parts-by-weight), and more desirably 0.5 to 3.0 pbw, relative to 100 pbw toner particles using a Henschel mixer or the like. When the hydrophobic strontium titanate particle content is less than 0.3 pbw, the effectiveness of the present invention is not attained, i.e., the excellent toner charge environmental stability and polishing are not achieved, and when the content exceeds 5.0 pbw, there is an undesirably large effect on the toner chargeability.

In the toner of the present invention, in addition to the hydrophobic strontium titanate particles, other well known fluidizing agents as external additive, e.g., silica particles, titania particles, alumina particles and the like, may be mixed with the toner particles as necessary as external additives.

The toner of the present invention produced in the manner described above may be used as either a two-component developer used together with a carrier, or as a monocomponent developer used without a carrier.

Specific examples of the present invention are described below.

EXAMPLES

Production of Toner Particles

Magenta Master Batch

Bisphenol polyester resin 70 pbw (Tg: 58° C., Tm: 100° C.)

Magenta pigment (C.I. pigment red 184) 30 pbw

A mixture of the above materials was loaded in a pressure kneader and kneaded. The obtained kneaded material was cooled, and thereafter pulverized using a feather mill to obtain the pigment master batch.

Toner particles 1

| | |
|---|---|
| Polyester resin (above) | 93 pbw |
| Magenta master batch (above) | 10 pbw |

The above materials were mixed using a Henschel mixer, and thereafter kneaded using a vented-type dual-shaft kneader. The obtained kneaded material was cooled, and thereafter coarsely pulverized using a feather mill, then finely pulverized using a jet mill, and subsequently classified to obtain toner particles having a volume-average size of 8.5 $\mu$m.

Production of Strontium Titanate Particles A

After adding $TiO_2$ and an equal molar quantity of $SrCl_2$ to a meta titanate slurry obtained by a sulfuric acid method, ammonia water was added while simultaneously introducing $CO_2$ gas at a flow rate of 1 L/min at double the molar quantity of $TiO_2$. The pH value was 8. Thereafter, the obtained precipitate was washed in water, drying for one day at 110° C., and subsequently sintered at 900° C. to produce strontium titanate particles A having a number-average particle size of 300 nm.

The obtained strontium titanate particles A were subjected to qualitative analysis via X-ray diffraction and peaks 1~4 of strontium carbonate were detected. The data are shown in the chart of part (a) of FIG. 1.

Strontium Titanate Particles B

After adding $TiO_2$ and an equal molar quantity of $SrCl_2$ to a meta titanate slurry obtained by a sulfuric acid method, ammonia water was added while simultaneously introducing $CO_2$ gas at a flow rate of 1 L/min at double the molar quantity of $TiO_2$. The pH value was 8. Thereafter, the obtained precipitate was washed in water, drying for one day at 110° C., and subsequently sintered at 800° C. to produce strontium titanate particles B having a number-average particle size of 100 nm.

The obtained strontium titanate particles B were subjected to qualitative analysis via X-ray diffraction and peaks of strontium carbonate were detected. The data are shown in the chart of part (a) of FIG. 1, and peaks 1~4 were confirmed.

The blow-off charge of B relative to iron powder was measured at +8 $\mu$c/g.

Strontium Titanate Particles C

After adding $TiO_2$ and an equal molar quantity of $SrCl_2$ to a meta titanate slurry obtained by a sulfuric acid method, ammonia water was added while simultaneously introducing $CO_2$ gas at a flow rate of 1 L/min at double the molar quantity of $TiO_2$. The pH value was 8. Thereafter, the obtained precipitate was washed in water, drying for one day at 110° C., and subsequently sintered at 1,000° C. to produce strontium titanate particles C having a number-average particle size of 700 nm.

The obtained strontium titanate particles B were subjected to qualitative analysis via X-ray diffraction and peaks of strontium carbonate were detected. The data are shown in the chart of part (a) of FIG. 1, and peaks 1~4 were confirmed. The blow-off charge of C relative to iron powder was measured at +3 $\mu$c/g.

Strontium Titanate Particles A1

To a 500 ml beaker was added 500 ml of 3N hydrochloric acid and 50 g particles A, and the materials were mixed for 1 hr at room temperature using a magnet stirrer. The supernatant was removed, washed and dried to obtain strontium titanate particles A0.

The obtained strontium titanate particles A0 were subjected to qualitative analysis via X-ray diffraction and peaks 1~4 of strontium carbonate were not detected. The data are shown in the chart of part (b) of FIG. 1. The particles A0 were subjected to surface processing by 1 wt % N-(2-aminoethyl)3-aminopropyltrimethoxysilane via a dry method to produce hydrophobic strontium titanate particles A1.

The blow-off charge of A1 relative to iron powder was measured at +110 $\mu$c/g.

Strontium Titanate Particles A2

The particles A0 were subjected to surface processing with 1 wt % n-butyltrimethoxysilane via a dry method to produce hydrophobic strontium titanate particles A2.

The blow-off charge of A2 relative to iron powder was measured at −50 $\mu$c/g. Furthermore, the number-average particle size was 300 nm, the content of particles of number-size 1000 or greater was 5 number-percent, and hydrophobicity was 60%.

Strontium Titanate Particles A3

The particles A0 were subjected to surface processing with 1 wt % fluoride-transformed silicone oil via a dry method to produce hydrophobic strontium titanate particles A3.

The blow-off charge of A3 relative to iron powder was measured at −100 $\mu$c/g. Furthermore, the number-average particle size was 300 nm, the content of particles of number-size 1000 or greater was 5 number-percent, and hydrophobicity was 60%.

Strontium Titanate Particles B1

To a 500 ml beaker was added 500 ml of 3N hydrochloric acid and 50 g particles B, and the materials were mixed for 1 hr at room temperature using a magnet stirrer. The supernatant was removed, washed and dried to obtain strontium titanate particles B0.

The obtained strontium titanate particles B0 were subjected to qualitative analysis via X-ray diffraction and peaks of strontium carbonate were not detected. The data are shown in the chart of part (b) of FIG. 1.

The particles B0 were subjected to surface processing by 1 wt % fluoride-transformed silicone oil via a dry method to produce hydrophobic strontium titanate particles B1.

The blow-off charge of B1 relative to iron powder was measured at −130 $\mu$c/g. Furthermore, the number-average particle size was 100 nm, the content of particles of number-size 1000 or greater was 2 number-percent, and hydrophobicity was 60%.

Strontium Titanate Particles C1

To a 500 ml beaker was added 500 ml of 3N hydrochloric acid and 50 g particles C, and the materials were mixed for 1 hr at room temperature using a magnet stirrer. The supernatant was removed, washed and dried to obtain strontium titanate particles C0.

The obtained strontium titanate particles B0 were subjected to qualitative analysis via X-ray diffraction and peaks of strontium carbonate were not detected. The data are shown in the chart of part (b) of FIG. 1.

The particles C0 were subjected to surface processing by 1 wt % fluoride-transformed silicone oil via a dry method to produce hydrophobic strontium titanate particles C1.

The blow-off charge of C1 relative to iron powder was measured at −80 $\mu$c/g. Furthermore, the number-average particle size was 700 nm, the content of particles of number-size 1000 or greater was 15 number-percent, and hydrophobicity was 60%.

Strontium Titanate Particles D1

The particles A were not treated for removal of strontium carbonate but were subjected to surface processing by 1 wt % N-(2-aminoethyl)3-aminopropyltrimethoxysilane via a dry method to produce hydrophobic strontium titanate particles D1.

The blow-off charge of D1 relative to iron powder was measured at +20 $\mu$c/g. Furthermore, the number-average particle size was 300 nm, the content of particles of number-size 1000 or greater was 5 number-percent, and hydrophobicity was 20%.

Strontium Titanate Particles D2

The particles A were not treated for removal of strontium carbonate but were subjected to surface processing by 1 wt % n-butyltrimethoxysilane via a dry method to produce hydrophobic strontium titanate particles D2.

The blow-off charge of D2 relative to iron powder was measured at −10 μc/g. Furthermore, the number-average particle size was 300 nm, the content of particles of number-size 1000 or greater was 5 number-percent, and hydrophobicity was 20%.

Strontium Titanate Particles D3

The particles A were not treated for removal of strontium carbonate but were subjected to surface processing by 1 wt % fluoride-transformed silicone oil via a dry method to produce hydrophobic strontium titanate particles D3.

The blow-off charge of D3 relative to iron powder was measured at −10 μc/g. Furthermore, the number-average particle size was 300 nm, the content of particles of number-size 1000 or greater was 5 number-percent, and hydrophobicity was 20%.

Method of Measuring Blow-off Charge Q of Strontium Titanate Particles Relative to Iron Powder The blow-off charge Q of the strontium titanate particles relative to iron powder was measured by the method described below. A mixture of 25 g standard iron powder carrier (Z150/250; Powder Tech, Inc.) and a 50 mg specimen sample was introduce to a 25 cc plastic bottle and mixed for 1 min via a Turbler mixer, then 0.1 g of the carrier mixture sample was place din a measuring vessel provided with a 400 mesh stainless steel screen, and nitrogen gas was introduced as a carrier gas for 60 sec at a pressure of 1.0 $kgf/cm^2$, and an indicator value was calculated using a blow-off charge measuring device (TB-200; Toshiba Chemical Co., Ltd.) to accomplish the blow-off charge measurement.

Measurement Method for Determining Content of Number-average Particle Size and Number-size Over 1,000 nm of Strontium Titanate Particles The particle size of 100 particles was measured via observation using a transmission-type electron microscope. The measurement magnification was 40,000x~60,000x, with target particles 0.5 nm and larger.

Method of Measuring Hydrophobicity

To an Erlenmeyer flask were added 0.2 g of specimen and 50 ml of water. Methanol was titrated from a burette. The solution in the flask at this time was normally mixed with a magnet stirrer. The end of specimen precipitation was confirmed by suspension of the entire quantity in the fluid, and hydrophobicity was expressed as a percentage of methanol at the precipitation end point and methanol weight in the fluid mixture.

Toner Production

The toners were manufactured under the conditions listed below by adding external additive to toner particles using the coating components represented in the examples and comparative examples below.

Manufacturing Device: Henschel mixer FM10B; blade shape: top blade Y, bottom blade A.

Manufacturing conditions: external additive was added to a batch of 1 kg toner particles, and mixed for 5 min at a blade rotation sped of 3640 rpm.

Example 1

| | |
|---|---|
| Toner particle 1 | 100 pbw |
| Hydrophobic silica H2000 (Clariant, Inc.) | 0.7 pbw |
| Strontium titanate particles A1 | 1.0 pbw |

Example 2

| | |
|---|---|
| Toner particle 1 | 100 pbw |
| Hydrophobic silica H2000 (Clariant, Inc.) | 0.7 pbw |
| Strontium titanate particles A2 | 1.0 pbw |

Example 3

| | |
|---|---|
| Toner particle 1 | 100 pbw |
| Hydrophobic silica H2000 (Clariant, Inc.) | 0.7 pbw |
| Strontium titanate particles A3 | 1.0 pbw |

Example 4

| | |
|---|---|
| Toner particle 1 | 100 pbw |
| Hydrophobic silica H2000 (Clariant, Inc.) | 0.7 pbw |
| Strontium titanate particles B1 | 1.0 pbw |

Example 5

| | |
|---|---|
| Toner particle 1 | 100 pbw |
| Hydrophobic silica H2000 (Clariant, Inc.) | 0.7 pbw |
| Strontium titanate particles C1 | 1.0 pbw |

Comparative Example 1

| | |
|---|---|
| Toner particle 1 | 100 pbw |
| Hydrophobic silica H2000 (Clariant, Inc.) | 0.7 pbw |
| Strontium titanate particles D1 | 1.0 pbw |

Comparative Example 2

| | |
|---|---|
| Toner particle 1 | 100 pbw |
| Hydrophobic silica H2000 (Clariant, Inc.) | 0.7 pbw |
| Strontium titanate particles D2 | 1.0 pbw |

Comparative Example 3

| | |
|---|---|
| Toner particle 1 | 100 pbw |
| Hydrophobic silica H2000 (Clariant, Inc.) | 0.7 pbw |
| Strontium titanate particles D3 | 1.0 pbw |

Developer Production

Developer was produced by mixing the respective toners and carrier 1 described later to attain a toner density of 6%.

Evaluations

Toner Charge Environmental Stability

The difference in developer charge was evaluated after storing the developer for 1 hr under LL (10° C., 15% RH) conditions, and after storing for 1 hr under HH (30° C., 85% RH) conditions.

O: absolute value of difference between LL and HH ≦5 (μc/g)

Δ: (μc/g)<absolute value of difference between LL and HH<10 (μc/g)

X: 10 (μc/g)≦absolute value of difference between LL and HH

Figure 2:
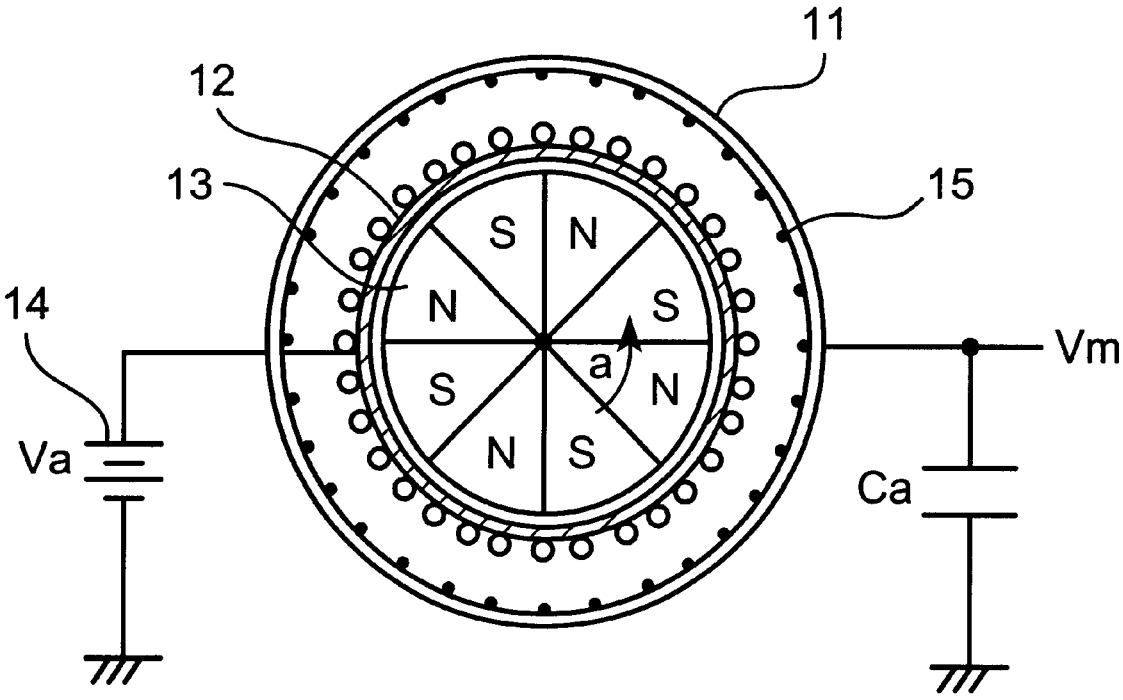
FIG. 2 briefly shows the construction of a charge-measuring device.

The charge was measured using the charge-measuring device shown in FIG. 2. First, the speed of a magnetic roller (13) was set at 100 rpm, and 1 g of developer was weighed on a precision scale, and placed uniformly on the entire surface of a conductive sleeve (12). Then, a bias voltage of −3 kv of the same polarity as the toner charge potential was applied via a bias power source (14), and the sleeve was rotated for 30 sec, at which time the sleeve was stopped and the potential was read. the weight of the toner (15) adhered to a circular electrode (11) at this time was weighed on a precision scale to obtain the average charge amount.

Cleaning Characteristics

Developer was loaded in a full color copier (CF900; Minolta Co., Ltd.), and 10,000 prints were made of a document having a 15% image area, then the filming and black spots (BS) condition on the photosensitive member were evaluated.

O: No filming or black spots

Δ: Slight filming and black spots, but not visible in the printed image

X: Filming and black spots appear, and confirmed in the image.

These results are shown in Table 1.

Carrier Production

Carrier 1

To a flask of 500 ml capacity provided with a mixer, condenser, thermometer, nitrogen inlet tube, and titration device was added 100 pbw methylethylketone. Under a nitrogen gas atmosphere at 80° C., 36.7 pbw methylmethacrylate, 5.1 pbw 2-hydroxyethylmethacryalte, 58.2 pbw 3-methacryloxypropyltris(trimethylsiloxane) silane, and 1 pbw 1,1'-azobis(siloxane-1-carbonitrile) were dissolved in the 100 pbw methylethylketone, and the obtained solution was titrated for 2 hr in a reaction vessel, then heated for 5 hr.

The obtained resin was adjusted to an OH/NCO molar ratio of 1/1 by adding isophoronediisocyanate/trimethylolpropane adduct (IPDI/TMP: NCO %=6.1%) as a crosslinking agent, and thereafter diluting with methylethylketone to obtain a coating resin solution having a fixed ratio of 3 wt %.

Calcinated ferrite powder F-300 (volume-average particle size: 50 μm; Powder Tech, Inc.) was used as a core material which was coated with the coating resin to achieve 1.5 pbw coating resin relative to the core material using a SPIRA COTA (Okada Seiko, K.K.), and the material was then dried. The obtained carrier was calcinated by standing for 1 hr at 160° C. in an oven with internal air circulation. After cooling, the bulk ferrite powder was pulverized using a sieve shaker provided with screen meshes with 106 μm and 75 μm openings to obtain the resin coated carrier 1.

Resin Glass Transition Temperature Tg Measuring Method

A differential scanning calorimeter (DSC-200; Seiko Electronic Industries, Ltd.) was used measure 10 mg of specimen under rising temperature between 20~120° C. for 10 min , using alumina as a reference, and the shoulder value of the main endothermic peak was designated the glass transition temperature.

Toner Volume-average Particle Size Measuring Method

Toner particle size was measured using a Coulter Multisizer 2.

Resin Transition Temperature Tm Measuring Method

A flow tester (CFT-500; Shimadzu Seisakusho K.K.) was used to plot the height from the flow starting point to the flow endpoint when a 1 $cm^3$ specimen was melted under 30 $kg/cm^2$ pressure and rising temperature of 3° C./min, and the temperature equivalent to 1.2 the height between the flow starting point and the flow ending point was designated the transition temperature.

TABLE 1

| | Charge environmental stability | | | Cleaning |
|---|---|---|---|---|
| | Charge amount (μC/g) | | | Character- |
| | LL | HH | Evaluation | istics |
| Ex. 1 | −30 | −28 | ○ | ○ |
| Ex. 2 | −28 | −24 | ○ | ○ |
| Ex. 3 | −23 | −18 | ○ | ○ |
| Ex. 4 | −26 | −22 | ○ | ○ |
| Ex. 5 | −21 | −18 | ○ | ○ |
| Com. Ex. 1 | −28 | −16 | X | Δ |
| Com. Ex. 2 | −27 | −17 | X | ○ |
| Com. Ex. 3 | −27 | −17 | X | ○ |

It was determined that the toners of the examples all had excellent environmental stability, and it was further determined that the charge levels moved in accordance with the blow off charge levels of the respective strontium titanate particles, and the toner further has excellent charge level adjustability.

Although the present invention has been fully described by way of examples with reference to the accompanying drawings, it is to be noted that various changes and modification will be apparent to those skilled in the art.

Therefore, unless otherwise such changes and modifications depart from the scope of the present invention, they should be construed as being included therein.

What is claimed is:

1. A toner for developing an electrostatic latent image comprising:

toner particles including a binder resin and colorant; and an external additive being mixed with the toner particles and comprising strontium titanate particles that have a number-average particle size of 80 to 800 nm, a content of the strontium titanate particles of 1000 nm or greater being less than 20 number-percent, the strontium titanate particles not having a peak of strontium carbonate in qualitative analysis by X-ray diffraction and being hydrophobic strontium titanate particles treated with a surface-treating agent.

2. The toner of claim 1, wherein the strontium titanate particles have the number-average particle size of 150 to 600 nm, the content of the strontium titanate particles of 1000 nm or greater being less than 10 number-percent.

3. The toner of claim 1, wherein an amount of the hydrophobic strontium titanate particles is 0.3 to 5 parts by weight relative to 100 parts by weight of the toner particles.

4. The toner of claim 1, wherein the strontium titanate particles are obtained by removing the strontium carbonate.

5. The toner of claim 4, wherein the strontium carbonate is removed from the strontium titanate particles by treating the strontium titanate particles with a strong acid solution.

6. The toner of claim 1, wherein the strontium titanate particles have a hydrophobicity of 40% or greater.

7. The toner of claim 6, wherein the hydrophobicity is 50 to 80%.

8. The toner of claim 1, wherein the toner particles have a volume-average particle size of 4 to 9 $\mu$m, and include a charge controller and a releasing agent.

9. A toner for developing an electrostatic latent image comprising:

toner particles including a binder resin and colorant;

a first external additive being mixed with the toner particles and comprising strontium titanate particles that have a number-average particle size of 80 to 800 nm, a content of the strontium titanate particles of 1000 nm or greater being less than 20 number-percent, the strontium titanate particles not having a peak of strontium carbonate in qualitative analysis by X-ray diffraction and being hydrophobic strontium titanate particles treated with a surface-treating agent; and a second external additive being mixed with the toner particles and comprising a fluidizing agent.

10. The toner of claim 9, wherein the strontium titanate particles have the number-average particle size of 150 to 600 nm, the content of the strontium titanate particles of 1000 nm or greater being less than 10 number-percent.

11. The toner of claim 9, wherein an amount of the hydrophobic strontium titanate particles is 0.3 to 5 parts by weight relative to 100 parts by weight of the toner particles.

12. The toner of claim 9, wherein the strontium titanate particles are obtained by removing the strontium carbonate.

13. The toner of claim 12, wherein the strontium carbonate is removed from the strontium titanate particles by treating the strontium titanate particles with a strong acid solution.

14. The toner of claim 9, wherein the fluidizing agent is selected from the group consisting of silica particles, titania particles and alumina particles.

15. The toner of claim 9, wherein the strontium titanate particles have a hydrophobicity of 40% or greater.

16. The toner of claim 15, wherein the hydrophobicity is 50 to 80%.

17. The toner of claim 9, wherein the surface treating agent is selected from the group consisting of a synthetic resin, a silane coupling agent and a silicone oil.

18. The toner of claim 9, wherein the toner particles have a volume-average particle size of 4 to 9 $\mu$m, and include a charge controller and a releasing agent.

* * * * *